US005213944A

United States Patent [19]

Adin

[11] Patent Number: 5,213,944

[45] Date of Patent: May 25, 1993

[54] NUCLEATED HIGH CONTRAST PHOTOGRAPHIC ELEMENTS CONTAINING SUBSTITUTED THIOUREAS WHICH ENHANCE SPEED AND INCREASE CONTRAST

[75] Inventor: Anthony Adin, Rochester, N.Y.

[73] Assignee: Eastman Kodak Company, Rochester, N.Y.

[21] Appl. No.: 825,349

[22] Filed: Jan. 24, 1992

Related U.S. Application Data

[63] Continuation-in-part of Ser. No. 778,028, Oct. 17, 1991.

[51] Int. Cl.[5] ..... G03C 1/06

[52] U.S. Cl. ..... 430/264; 430/605; 430/603; 430/598

[58] Field of Search ..... 430/264, 605, 603, 598

[56] References Cited

U.S. PATENT DOCUMENTS

| | | | |
|---|---|---|---|
| 3,297,446 | 1/1967 | Dunn | 430/613 |
| 4,629,678 | 12/1986 | Murai | 430/603 |
| 4,686,167 | 8/1987 | Resnick et al. | 430/264 |
| 4,810,626 | 3/1989 | Burgmaier et al. | 430/569 |
| 4,962,017 | 10/1990 | Nakamura | 430/551 |
| 4,975,354 | 4/1990 | Machonkin et al. | 430/264 |
| 4,988,604 | 1/1991 | Machonkin et al. | 430/264 |
| 5,041,355 | 8/1991 | Machonkin et al. | 430/264 |
| 5,049,485 | 9/1991 | Deaton | 430/605 |
| 5,126,227 | 6/1992 | Machonkin et al. | 430/264 |

FOREIGN PATENT DOCUMENTS

| | | | |
|---|---|---|---|
| 0302528 | 2/1989 | European Pat. Off. . | |
| 2089947 | 4/1987 | Japan | 430/603 |

*Primary Examiner*—Charles L. Bowers, Jr.
*Assistant Examiner*—Thomas R. Neville
*Attorney, Agent, or Firm*—Alfred P. Lorenzo

[57] ABSTRACT

Silver halide photographic elements which are capable of high-contrast development and are especially useful in the field of graphic arts comprise surface latent image forming high-chloride silver halide grains and have incorporated therein a hydrazine compound which functions as a nucleator, an amino compound which functions as an incorporated booster, and a combination of a gold compound and a thiourea compound which functions as a chemical sensitizer. Thiourea compounds effective for this purpose are substituted thioureas having one or two acyl substituents or having three alkyl substituents or having one aryl substituent and two alkyl substituents.

17 Claims, No Drawings

NUCLEATED HIGH CONTRAST PHOTOGRAPHIC ELEMENTS CONTAINING SUBSTITUTED THIOUREAS WHICH ENHANCE SPEED AND INCREASE CONTRAST

CROSS-REFERENCE TO RELATED APPLICATIONS

This application is a continuation-in-part of copending commonly assigned U.S. patent application Ser. No. 778,028, filed Oct. 17, 1991, pending, "Nucleated High Contrast Photographic Elements Containing Substituted Thioureas Which Enhance Speed and Increase Contrast" by Anthony Adin.

Copending commonly assigned U.S. patent application Ser. No. 735,979 filed Jul. 25, 1991, "Nucleated High Contrast Photographic Elements Containing Urea Compounds Which Enhance Speed And Increase Contrast" by Anthony Adin describes silver halide photographic elements which comprise surface latent image forming high-chloride silver halide grains and which have incorporated therein a hydrazine compound which functions as a nucleator, an amino compound which functions as an incorporated booster, and, as a chemical sensitizer, a combination of a gold compound and a 1,1,3,3-tetra-substituted middle chalcogen urea compound in which at least one substituent comprises a nucleophilic center.

FIELD OF THE INVENTION

This invention relates in general to photography and in particular to novel black-and-white photographic elements. More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

While the high-contrast photographic elements of U.S. Pat. No. 4,975,354 represent a major advance in the art, there is a continuing need to improve the properties of these photographic elements, for example, to provide increased photographic speed and even higher contrast. Moreover, enhanced developability of these high-contrast elements, which would enable the use of very short development times, would also be highly beneficial in the field of graphic arts.

It is a well known expedient to increase photographic speed by the use of chemical sensitizing agents, and a very wide variety of different compounds are known to be useful as chemical sensitizers (see, for example, Research Disclosure, Issue No. 308, Item 308119, Paragraph III, December, 1989). However, the use of chemical sensitizing agents can adversely affect other properties of silver halide emulsions which contain a hydrazine compound that functions as a nucleator and an amino compound that functions as an incorporated booster, for example, it can adversely affect contrast or result in an increase in fog.

Sodium thiosulfate is commonly used as a chemical sensitizing agent for photographic silver halide emulsions. Thiourea is also a well known chemical sensitizing agent as described, for example, in U.S. Pat. No. 1,623,499 However, as shown herein, sodium thiosulfate and thiourea are not effective chemical sensitizers for emulsions that contain a hydrazine compound that functions as a nucleator and an amino compound that functions as an incorporated booster.

Use of sulfur sensitizers, including thioureas, as compounds which are capable of selectively sensitizing the (100) plane of silver halide grains is described in European Patent Application No. 0 302 528, published Feb. 8, 1989. However, the emulsion systems described in this patent application do not contain a hydrazine compound that functions as a nucleator nor an amino compound that functions as an incorporated booster.

Certain 1,1,3,3-tetra-substituted middle chalcogen urea compounds that are highly effective chemical sensitizers are described in U.S. Pat. No. 4,810,626. Use of these compounds as sensitizers in high-chloride emulsions that contain a hydrazine compound that functions as a nucleator and an amino compound that functions as an incorporated booster is described in the aforesaid copending commonly assigned U.S. patent application Ser. No. 735,979, filed Jul. 25, 1991.

It is toward the objective of providing an improved high-contrast photographic element—containing both a hydrazine compound that functions as a nucleator and an amino compound that functions as an incorporated booster—that has enhanced developability and that exhibits increased speed and increased toe contrast, without a concurrent increase in fog, that the present invention is directed.

SUMMARY OF THE INVENTION

The present invention provides novel silver halide photographic elements which are adapted to form a high-contrast image when development is carried out with an aqueous alkaline developing solution. The novel photographic elements of this invention comprise:

(1) surface latent image forming high-chloride silver halide grains, (2) a hydrazine compound that functions as a nucleator, (3) an amino compound that functions as an incorporated booster, (4) a gold compound that functions as a chemical sensitizer, and (5) a thiourea compound that functions as a chemical sensitizer, said thiourea compound having one to three substituents and being represented by formula I or formula II as follows:

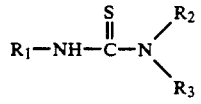

I

-continued

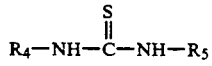

II wherein $R_1$, $R_2$ and $R_3$ are, independently, an alkyl group or an aryl group with the proviso that only one of $R_1$, $R_2$, and $R_3$ is an aryl group and $R_4$ and $R_5$ are, independently, a hydrogen atom or an acyl group with the proviso that at least one of $R_4$ and $R_5$ is an acyl group.

Alkyl groups represented by $R_1$, $R_2$, and $R_3$ preferably contain 1 to 10 carbon atoms, and more preferably 1 to 4 carbon atoms. Examples of such groups include methyl, ethyl, n-propyl, isopropyl, n-butyl, isobutyl, tert-butyl, pentyl, hexyl, octyl, nonyl and decyl groups. Aryl groups represented by $R_1$, $R_2$ and $R_3$ preferably contain 6 to 15 carbon atoms, and more preferably 6 to 10 carbon atoms. Examples of such groups include phenyl, tolyl and naphthyl. Acyl groups represented by $R_4$ and $R_5$ are groups of the formula:

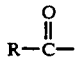

where R is alkyl, preferably containing 1 to 10 carbon atoms, and more preferably 1 to 4 carbon atoms. Examples of such groups include acetyl, propionyl, and butyryl.

Use of high-chloride silver halide grains in the photographic elements of this invention promotes nucleatability and provides enhanced developability which renders feasible the use of very short development times and moderate development temperatures. While effective chemical sensitization of such high-chloride emulsions is typically very difficult to achieve, it is accomplished in this invention by the use, as chemical sensitizers, of the combination of a gold compound with the aforesaid substituted thiourea compound. This combination unexpectedly provides the desired characteristics of high speed and high contrast without an increase in fog.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

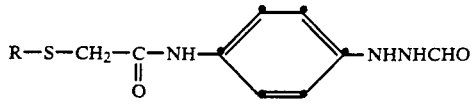

where R is an alkyl or cycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar, 14, 1988 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

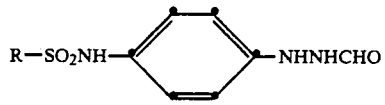

I or

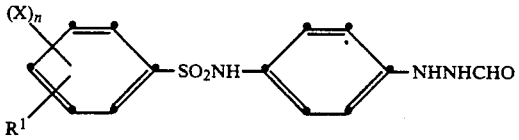

II wherein:

R is alkyl having from 6 to 18 carbon atoms or a heterocyclic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ or $—SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR^2$ or $—NHSO_2R^2$ where $R^2$ is as defined above. Preferred R alkyl groups contain from about 8 to about 16 carbon atoms, since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —NHCOR$^2$— or —NHSO$_2$R$^2$, where R$^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

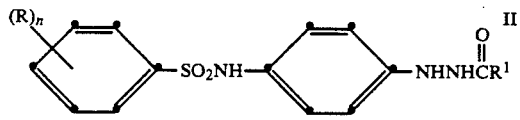

where each R is a monovalent group comprised of at least three repeating ethyleneoxy units, n is 1 to 3, and R$^1$ is hydrogen or a blocking group.

These hydrazides are described in Machonkin and Kerr, U.S. Pat. No. 5,041,355, issued Aug. 20, 1991.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

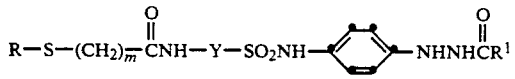

where R is a monovalent group comprised of at least three repeating ethyleneoxy units, m is 1 to 6, Y is a divalent aromatic radical, and R$^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

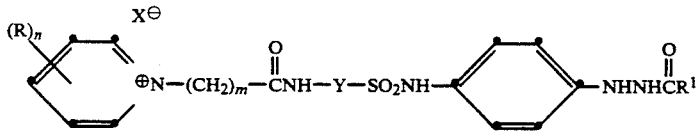

where each R is an alkyl group, preferably containing 1 to 12 carbon atoms, n is 1 to 3, X is an anion such as chloride or bromide, m is 1 to 6, Y is a divalent aromatic radical, and R$^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by R$^1$ can be, for example:

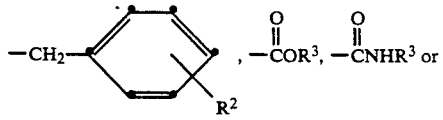

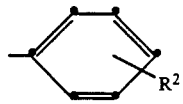

where R$^2$ is hydroxy or a hydroxy-substituted alkyl group having from 1 to 4 carbon atoms and R$^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,975,354, 4,988,604, 4,994,365, and 5,041,355.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The nucleated high-contrast photographic elements of this invention utilize surface latent image forming high-chloride silver halide grains. By the term "high-chloride silver halide grains", as used herein, is meant silver halide grains in which at least the surface portion is composed of more than 50 mole percent silver chloride. Both conventional grains which are more than 50 percent silver chloride and grains of the core-shell type in which the shell is more than 50 percent silver chloride, can be employed with satisfactory results. Preferably, the silver halide grains utilized in this invention are at least 70 mole percent chloride. Use of high-chloride silver halide grains is highly advantageous in promoting the developability of the high contrast element, and thereby providing for the short development times that are critically needed in the field of graphic arts.

Preferably, the silver halide grains are monodispersed and have a mean grain size of not larger than about 0.7 micrometers, and more preferably of about 0.4 micrometers or less.

Typically, the silver laydown is in the range of from about 0.5 to about 10 grams per square meter, and preferably in the range of from about 2 to about 5 grams per square meter.

As described hereinabove, the silver halide grains utilized in this invention are capable of forming a surface latent image, as opposed to being of the internal latent image forming type. Thus, the silver halide emulsion layer is negative working. The silver halide grains can be of any suitable geometric form, e.g., regular cubic or octahedral crystalline forms. It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the high-chloride silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3,

M′ represents chromium, rhenium, ruthenium, osmium or iridium, and L′ represents one or a combination of halide and cyanide ligands or a combination of these ligands with up to two aquo ligands.

As an alternative to the use of a doping agent, an electron-accepting antifogging dye can be incorporated in the emulsion. Such dyes and their use in nucleated photographic elements are described in Gilman et al, U.S. Pat No. 4,933,273.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more, it is preferred that the binder be present in a concentration of 250 grams per mole of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin), gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids, the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically, the binders are hardened with one or more hardeners, such as those described in Paragraph VII, Product Licensing Index, Vol. 92, December 1971, Item 9232, which disclosure is hereby incorporated by reference.

The silver halide emulsions utilized in this invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

The high-contrast photographic elements of this invention can, optionally, contain, for the purpose of reducing pepper fog and controlling image spread, a thioether compound as described in copending commonly-assigned U.S. patent application Ser. No. 735,975, filed Jul. 25, 1991, "Nucleated High Contrast Photographic Elements Containing Thioether Compounds To Inhibit Pepper Fog And Restrain Image Spread", by H. I. Machonkin and D. L. Kerr. These are compounds which are free of both hydrazino and amino functionality and which:

(1) contain within their structure at least one thio (—S—) group, (2) contain within their structure a group comprised of at least three repeating ethyleneoxy units, and (3) have a partition coefficient (as herein defined) of at least one. Preferred thioether compounds are those of the formula:

$$R—S—(CH_2CH_2O)_n—R'$$

wherein R and R' are monovalent organic radicals which can be the same or different and n is an integer with a value of from 3 to 50, and more preferably from 10 to 30.

As an alternative to the use of the thioether compounds described above, control of pepper fog and image spread can be achieved in this invention by the use of hydrophobic isothiourea compounds as described in copending commonly-assigned U.S. patent application Ser. No. 599,218, filed Oct. 17, 1990, "High Contrast Photographic Elements Containing Ballasted Hydrophobic Isothioureas", by Harold I. Machonkin and Donald L. Kerr and issued Jun. 30, 1992, as U.S. Pat. No. 5,126,227 the disclosure of which is incorporated herein by reference.

These are compounds which have a partition coefficient (as hereinafter defined) of at least one and comprise a ballasting group, attached to the sulfur atom, which serves to restrict the mobility of the compound and thereby aid in retaining it in the photographic element during development. Preferred hydrophobic isothiourea compounds are those represented by the formula:

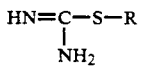

wherein R is a ballasting group that contains at least six carbon atoms and is substantially free of solubilizing groups.

As a further alternative to use of the thioether compounds of the aforesaid patent application Ser. No. 735,975, or the isothiourea compounds of the aforesaid patent application Ser. No. 599,218, control of pepper fog and image spread can be achieved by use of the ballasted thioether isothioureas described in copending commonly assigned U.S. patent application Ser. No. 778,037, filed Oct. 17, 1991, "Nucleated High Contrast Photographic Elements Containing Ballasted Thioether Isothioureas To Inhibit Pepper Fog And Restrain Image Spread", by H. I. Machonkin and D. L. Kerr. The ballasted thioether isothioureas are compounds of the formula:

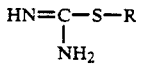

wherein R is a monovalent thioether group of such size and configuration as to confer on the isothiourea sufficient bulk as to render it substantially non-diffusible.

The photograhic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

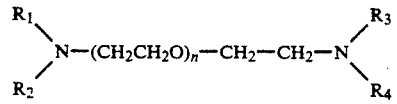

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

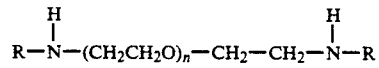

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

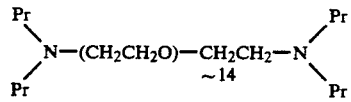

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

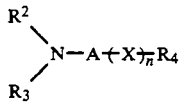

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$—, —$NR^5COO$—, —COO—, —OCO—, —CO—, —$NR^5CO$—, —$SO_2NR^5$—, —$NR^5SO_2$—, $SO_2$, —S— or —O— group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

Particularly preferred sensitizing dyes for use in this invention are the benzimidazolocarbocyanine dyes described in copending commonly assigned U.S. patent application Ser. No. 735,484, filed Jul. 25, 1991, "Nucleated High Contrast Photographic Elements Containing Low-Stain Sensitizing Dyes", by Anthony Adin, Linda J. Knapp and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

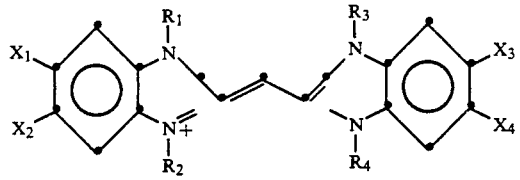

wherein $X_1$, $X_2$, $X_3$ and $X_4$ are, independently, hydrogen, cyano, alkyl, halo, haloalkyl, alkylthio, alkoxycarbonyl, aryl or substituted or unsubstituted carbamoyl;

$R_1$ and $R_3$ are alkyl;

and $R_2$ and $R_4$ are, independently, alkyl, alkenyl, substituted alkyl or substituted alkenyl, with the proviso that at least one of $R_2$ and $R_4$ is acid-substituted alkyl, and with the further proviso that when both $R_2$ and $R_4$ are acid-substituted alkyl, there is also a cation present to balance the charge.

An essential component of the high-contrast silver halide photographic elements of this invention is a gold compound that functions as a chemical sensitizer. The use of gold compounds as chemical sensitizers is very well known in the art. (See for example, U.S. Pat. Nos. 3,297,446 and 3,503,749). Gold compounds useful as chemical sensitizers in this invention include:

gold chloride,
gold sulfide,
gold iodide,
potassium tetrachloroaurate,
potassium aurothiocyanate,
aurous dithiosulfate and the like.

A preferred class of gold compounds for use as chemical sensitizers in this invention are the gold (I) compounds described in copending, commonly assigned U.S. patent application Ser. No. 614,536, filed Nov. 16, 1990, "Photographic Silver Halide Material Comprising Gold Compound", by J. C. Deaton, and issued Sep. 17, 1991, as U.S. Pat. No. 5,049,485, the disclosure of which is incorporated herein by reference. These are compounds of the formula:

$$AuL_2^+X^- \text{ or } AuL(L^1)^+X^-$$

wherein

L is a mesoionic compound;
X is an anion; and
$L^1$ is a Lewis donor ligand.

Preferably L is represented by the formula:

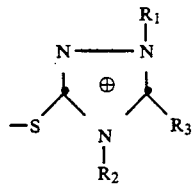

wherein $R_1$, $R_2$ and $R_3$ individually are hydrogen or a hydrocarbon group.

A particularly preferred species is aurous bis(1,4,5-trimethyl-1,2,4-triazolium-3-thiolate) tetrafluoroborate, which has the formula:

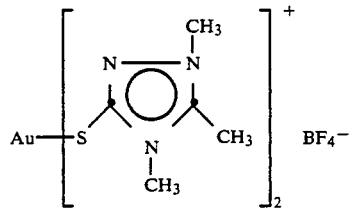

A second preferred class of gold compounds for use as chemical sensitizers in this invention are the gold (I) compounds described in copending commonly assigned U.S. patent application Ser. No. 614,537, filed Nov. 16, 1990, "Photographic Silver Halide Material And Process", by J. C. Deaton, and issued Sep. 17, 1991, as U.S. Pat. No. 5,049,484, the disclosure of which is incorporated herein by reference. These are compounds of the formula:

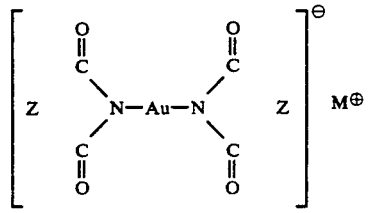

wherein Z represents the substituted or unsubstituted nitrogen and carbon atoms necessary to complete a 5- or 6-member imide nucleus; and M is a cation, preferably sodium, tetraethyl ammonium or potassium. The protonated form of the imide nucleus preferably has a pKa in the range of 7 to 12, and more preferably 8 to 11, Z is preferably

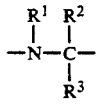

wherein $R^1$, $R^2$ and $R^3$ individually are hydrogen or a hydrocarbon group, preferably a substituted or unsubstituted hydrocarbon group containing 1 to 15 carbon atoms, such as an alkyl group, for example, methyl, ethyl, propyl, n-butyl and t-butyl, and octyl groups, or phenyl groups. $R^3$ is preferably hydrogen.

A particularly preferred species is bis(1-methylhydantoinato) gold (I) sodium salt, which has the formula:

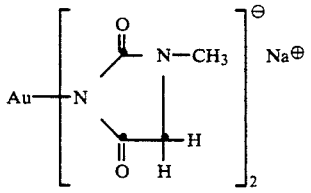

As hereinabove described, the present invention is based on the discovery that certain substituted thiourea compounds used in combination with gold compounds are highly effective chemical sensitizers for high contrast photographic elements which employ high-chloride silver halide grains and which, in accordance with the teachings of U.S. Pat. No. 4,975,354, include both a hydrazine compound which functions as a nucleator and an amino compound which functions as a booster. These high contrast elements are of a highly complex nature, and utilize the conjoint action of both a nucleator and an incorporated booster. Their performance is affected by the interaction of many variables and the manner in which emulsion addenda, such as chemical sensitizers, will function in such a complex system is unpredictable.

As hereinabove described, the substituted thiourea compounds utilized as chemical sensitizers in this invention are compounds of formula I or formula II as follows:

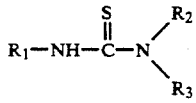

I

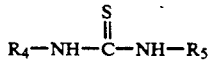

II wherein $R_1$, $R_2$ and $R_3$ are, independently, an alkyl group or an aryl group with the proviso that only one of $R_1$, $R_2$, and $R_3$ is an aryl group and $R_4$ and $R_5$ are, independently, a hydrogen atom or an acyl group with the proviso that at least one of $R_4$ and $R_5$ is an acyl group.

As indicated by formulas I and II, the substituted thiourea compounds that are useful in this invention have one or two acyl substituents, or have three alkyl substituents or have one aryl substituent and two alkyl substituents.

Examples of substituted thiourea compounds useful in this invention include the following:

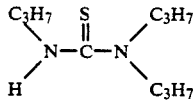

I

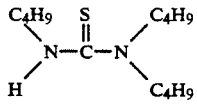

II

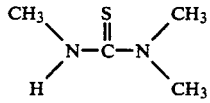

III

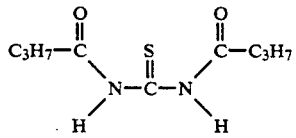

IV

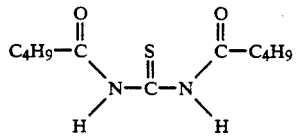

V

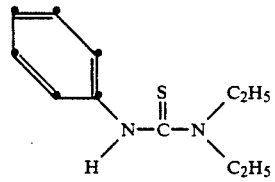

VI

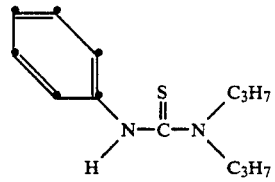

VII

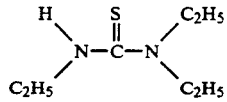

VIII

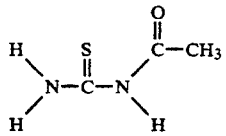

IX

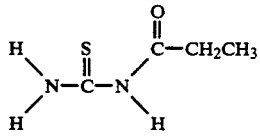

X

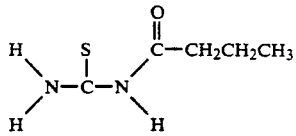

XI

-continued

XII

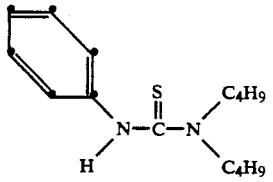

XIII

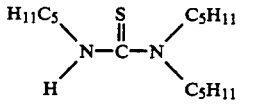

XIV

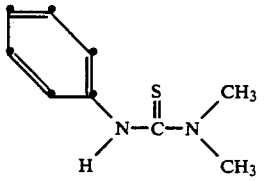

XV

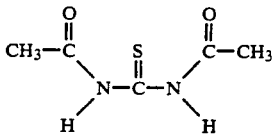

XVI

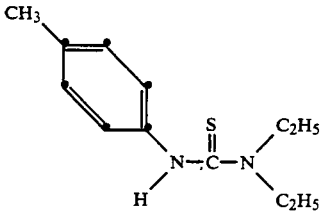

The substituted thiourea compound is typically employed in this invention in an amount of from about 0.1 to about 10 millimoles per mole of silver, and preferably in an amount of from about 0.003 to about 0.1 millimoles per mole of silver. The gold compound is typically employed in an amount of from about 0.0001 to about 10 millimoles per mole of silver, and preferably in an amount of from about 0.0005 to about 0.04 millimoles per mole of silver. Preferably the molar ratio of the substituted thiourea compound to the gold compound is greater than one.

The term "partition coefficient", as used herein, refers to the log P value of the compound with respect to the system n-octanol/water as defined by the equation:

$$\log P = \log \frac{[X]_{octanol}}{[X]_{water}}$$

where X=concentration of the compound. The partition coefficient is a measure of the ability of a compound to partition between aqueous and organic phases and is calculated in the manner described in an article by A. Leo, P. Y. C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P, the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media and a compound with a log P of two is one hundred times more soluble in organic media than in aqueous media.

The following examples are provided to further illustrate the invention. In these examples, the performance of the substituted thiourea compounds of this invention is compared with that of the following sulfur sensitizers:

$Na_2S_2O_3 \cdot 5H_2O$
Sodium thiosulfate — Sensitizer A

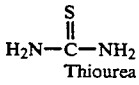
Thiourea — Sensitizer B

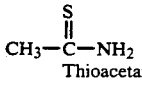
Thioacetamide — Sensitizer C

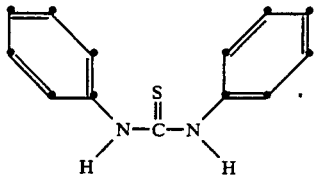
Thiocarbanilide — Sensitizer D

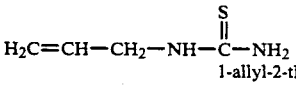
1-allyl-2-thiourea — Sensitizer E

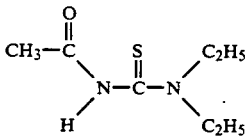
1-acetyl-3,3-diethyl-2-thiourea — Sensitizer F

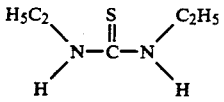
1,3-diethyl-2-thiourea — Sensitizer G

EXAMPLES 1–3

A 0.205 micron edge length AgClBr (70/30) photographic emulsion, rhodium-doped at 0.0094 mg/Ag mole was chemically sensitized with potassium tetrachloroaurate and a sulfur sensitizer, in the amounts indicated in Table I below, for 10 minutes at 65° C. In order to reduce R-typing, 0.14 mg/Ag mole of bis(2-amino-5-iodopyridine-dihydroiodide) mercuric iodide was incorporated in the emulsion. The following addenda were also incorporated in the emulsion:

(1) 225 mg/Ag mole of a sensitizing dye of the formula:

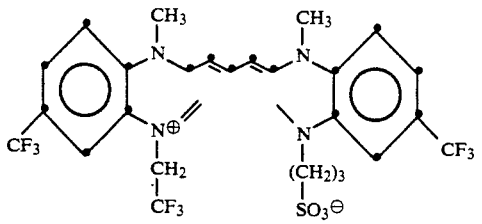

(2) 400 mg/Ag mole of the antifoggant 5-carboxy-4-hydroxy-6-methyl-2-methylmercapto-1,3,3a,-7tetraazaindene, (3) 100 mg/Ag mole of the antifoggant 5-bromo-4-hydroxy-6-methyl-1,3,3a,7-tetraazaindene, (4) 50 mg/Ag mole of the stabilizer 1-(3-acetamidophenyl)-5-mercaptotetrazole, (5) 2 g/Ag mole of a booster of the formula:

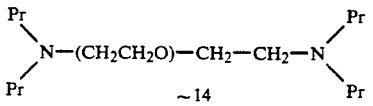

where Pr represents n-propyl and (6) 0.2 mmole/Ag mole of a nucleator of the formula:

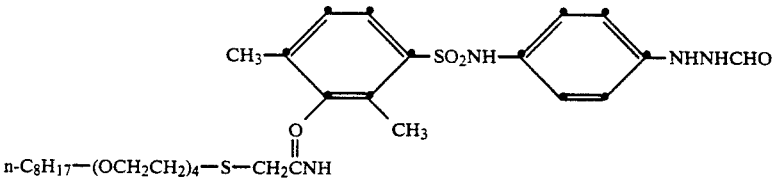

The emulsion was coated on a polyester support to give a silver laydown of 3.2 g/m$^2$, a gelatin laydown of 2.5 g/m$^2$, and a latex laydown of 1.06 g/m$^2$, where the latex is a copolymer of methyl acrylate, 2-acrylamido-2-methylpropane sulfonic acid and 2-acetoacetoxy-ethylmethacrylate. The emulsion layer was overcoated with gelatin hardened with 2 weight percent of bis(vinylsulfonylmethyl) ether, and coated at a laydown of 0.82 g/m$^2$.

Each film was exposed for 0.5 seconds by a 3000° K. tungsten source through a continuous wedge target, and developed for 30 seconds at 35° C.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid | 15 g |

-continued

| | |
|---|---|
| pentasodium salt (40% solution) | |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The concentrate was diluted at a ratio of one part of concentrate to two parts of water to produce a working strength developing solution with a pH of 10.35.

The speed of the film, measured at 0.1 density above gross fog and expressed in log units, is referred to below as the (0.1) Speed. The difference in Log E of the speeds at 0.1 and 4.0 above gross fog was also measured, and is referred to below as the (0.1–4) Speed. This is a measure of the separation of toe and shoulder speeds. Toe contrast, defined as the slope of the line joining the points on the H&D curve at 0.1 and 0.6 density units above gross fog, and referred to as "Toe Gamma", was also calculated. The results obtained are summarized in Table I below.

TABLE I

| Example No. | Sulfur Sensitizer | Concentration of Sulfur Sensitizer (mg/Ag mole) | Concentration of Potassium Tetrachloroaurate (mg/Ag mole) | Gross Fog | (0.1) Speed | (0.1–4) Speed | Toe Gamma |
|---|---|---|---|---|---|---|---|
| 1 | VIII | 2.2 | 3.0 | 0.035 | 2.38 | 0.19 | 13.4 |
| 2 | IX | 2.0 | 3.0 | 0.037 | 2.39 | 0.21 | 13.4 |
| 3 | XV | 2.2 | 3.0 | 0.035 | 2.37 | 0.26 | 12.5 |
| Control 1 | A | 1.8 | 3.0 | 0.035 | 2.32 | 0.26 | 11.3 |
| Control 2 | B | 1.6 | 4.0 | 0.035 | 2.32 | 0.36 | 10.0 |
| Control 3 | C | 1.6 | 4.0 | 0.050 | 2.41 | 0.28 | 9.8 |
| Control 4 | D | 3.6 | 3.0 | 0.057 | 2.41 | 0.26 | 9.4 |

Considering the results reported in Table I, it is apparent that use of the substituted thioureas of this invention provides significantly better results than use of the sensitizers employed in the control tests. Low toe speed, low toe contrast, high gross fog and high values for (0.1–4) Speed are all undesirable for graphic arts applications. Comparing examples 1 to 3, which respectively employed 1,3,3-triethyl-2-thiourea, 1-acetyl-2-thiourea and 1,3-diacetyl-2-thiourea, with the use of sodium thiosulfate in control test 1, it is seen that examples 1 to 3 provided higher toe speed and higher toe contrast. Comparing examples 1 to 3 with the use of thiourea in control test 2, it is seen that examples 1 to 3 provided higher toe speed, lower (0.1–4) Speed and higher toe contrast. Comparing examples 1 to 3 with the use of thioacetamide in control test 3, and the use of thiocarbanilide in control test 4, it is seen that examples 1 to 3 provided lower gross fog and higher toe contrast. The serious disadvantages provided by thioacetamide and thiocarbanilide in regard to high gross fog and low toe contrast outweigh the advantage of higher toe speed.

EXAMPLES 4 AND 5

The emulsion utilized in these examples was the same as that described in regard to Examples 1 to 3 except that the edge length of the AgClBr grains was 0.22 microns and the grains were rhodium-doped at 0.011 mg/Ag mole. The emulsion addenda utilized and the exposure, processing and testing were the same as that described in regard to Examples 1 to 3. The results obtained are summarized in Table II below.

TABLE II

| Example No. | Sulfur Sensitizer | Concentration of Sulfur Sensitizer (mg/Ag mole) | Concentration of Potassium Tetrachloroaurate (mg/Ag mole) | Gross Fog | (0.1) Speed | (0.1–4) Speed | Toe Gamma |
|---|---|---|---|---|---|---|---|
| 4 | IX | 2 | 2.6 | 0.030 | 2.18 | 0.23 | 11.9 |
| 5 | VI | 2 | 4 | 0.030 | 2.16 | 0.26 | 11.5 |
| Control 5 | A | 1.8 | 3 | 0.032 | 2.10 | 0.32 | 8.3 |
| Control 6* | A | 1.8 | 3 | 0.032 | 2.10 | 0.53 | 7.0 |
| Control 7 | E | 2 | 2.6 | 0.030 | 1.61 | 0.55 | 3.8 |
| Control 8 | F | 3.2 | 2 | 0.030 | 1.61 | 0.55 | 3.9 |
| Control 9* | G | 3 | 3 | 0.035 | 2.11 | 0.51 | 7.2 |

*In control tests 6 and 9, the concentrate was diluted at a ratio of one part of concentrate to four parts of water.

Considering the results reported in Table II, it is apparent that use of the substituted thioureas of this invention provides significantly better results than use of the sensitizers employed in the control tests. Comparing Examples 4 and 5, which respectively employed 1-acetyl-2-thiourea and 1-phenyl-3,3-diethyl-2-thiourea, with the use of sodium thiosulfate in control test 5 it is seen that Examples 4 and 5 provided higher toe speed and higher toe contrast. Comparing Examples 4 and 5 with the use of 1-allyl-2-thiourea in control test 7, it is seen that Examples 4 and 5 provided higher toe speed, lower (0.1–4) speed and higher toe contrast. Comparing Examples 4 and 5 with the use of 1-acetyl-3,3-diethyl-2-thiourea in control test 8, it is seen that Examples 4 and 5 provided higher toe speed, lower (0.1–4) speed and higher toe contrast. Control tests 6 and 9 utilizing, respectively, sodium thiosulfate and 1,3-diethyl-2-thiourea provided undesirably high values of (0.1–4) speed and undesirably low values for toe contrast.

It should be noted that the present invention is characterized by five critical features which must be employed in combination, namely:

(1) surface latent image forming high-chloride silver halide grains, (2) a hydrazine compound that functions as a nucleator, (3) an amino compound that functions as an incorporated booster, (4) a gold compound that functions as a chemical sensitizer, and (5) a substituted thiourea compound, as defined herein, that functions as a chemical sensitizer. The substituted thioureas employed in this invention have one or two acyl substituents, or have three alkyl substituents, or have one aryl substituent and two alkyl substituents. These sensitizers have been unexpectedly found to provide the desired combination of increased speed and increased toe contrast without a concurrent increase in fog. Use of the aforesaid five features in combination is highly advantageous in that it provides a photographic element characterized by a desired combination of properties including high speed, very high contrast, low fog and excellent developability.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) surface latent image forming high-chloride silver halide grains in which are least the surface portion thereof is composed of more than 50 mole percent silver chloride, (2) a hydrazine compound that functions as a nucleator, (3) an amino compound that functions as an incorporated booster, (4) a gold compound that functions as a chemical sensitizer, and (5) a thiourea compound that functions as a chemical sensitizer, said thiourea compound having formula I or II:

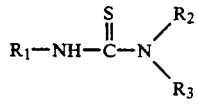

I

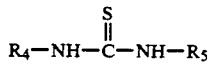

II wherein $R_1$, $R_2$ and $R_3$ are, independently, an alkyl group or an aryl group with the proviso that only one of $R_1$, $R_2$, and $R_3$ is an aryl group and $R_4$ and $R_5$ are, independently, a hydrogen atom or an acyl group with the proviso that at least one of $R_4$ and $R_5$ is an acyl group.

2. A silver halide photographic element as claimed in claim 1 wherein said silver halide grains are at least 70 mole percent silver chloride.

3. A silver halide photographic element as claimed in claim 1 wherein said silver halide grains have a mean grain size of about 0.4 micrometers or less.

4. A silver halide photographic element as claimed in claim 1 wherein said silver halide grains include a doping agent which enhances contrast.

5. A silver halide photographic element as claimed in claim 1 wherein said silver halide grains are rhodium-doped.

6. A silver halide photographic element as claimed in claim 1 wherein said hydrazine compound is an aryl sulfonamidophenyl hydrazide of the formula:

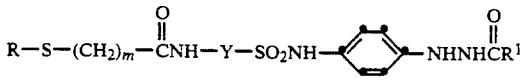

where R is a monovalent group comprised of at least three repeating ethyleneoxy units, m is 1 to 6, Y is a divalent aromatic radical, and $R^1$ is hydrogen or a blocking group.

7. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

8. A silver halide photographic element as claimed in claim 1 wherein said amino compound is a bis-tertiary amine of the formula:

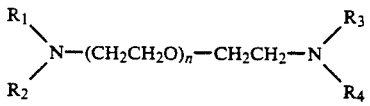

wherein n is an integer with a value of 3 to 50, $R_1$, $R_2$, $R_3$ and $R_4$ are independently alkyl groups of 1 to 8 carbon atoms, and $R_1$ and $R_2$ taken together and $R_3$ and $R_4$ taken together represent the atoms necessary to complete a heterocyclic ring.

9. A silver halide photographic element as claimed in claim 1 wherein said amino compound is a bis-secondary amine of the formula:

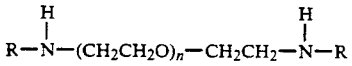

wherein n is an integer with a value of 3 to 50 and each R is independently a linear or branched, substituted or unsubstituted alkyl group of at least 4 carbon atoms.

10. A silver halide photographic element as claimed in claim 1 wherein said gold compound is potassium tetrachloroaurate.

11. A silver halide photographic element as claimed in claim 1 wherein said gold compound is aurous bis(1,4,5-trimethyl-1,2,4-triazolium-3-thiolate)-tetrafluoroborate.

12. A silver halide photographic element as claimed in claim 1 wherein said thiourea compound has the formula:

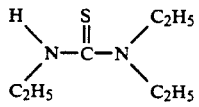

13. A silver halide photographic element as claimed in claim 1 wherein said thiourea compound has the formula:

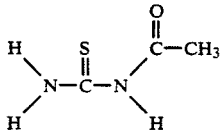

14. A silver halide photographic element as claimed in claim 1 wherein said thiourea compound has the formula:

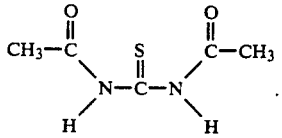

15. A silver halide photographic element as claimed in claim 1 wherein said thiourea compound has the formula:

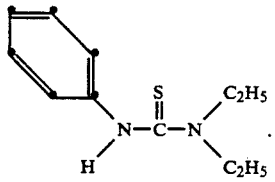

16. A silver halide photographic element as claimed in claim 1 wherein said hydrazine compound is present in an amount of from about 0.1 to about 10 millimoles per mole of silver, said amino compound is present in an amount of from about 0.1 to about 25 millimoles per mole of silver, said gold compound is present in an amount of from about 0.0001 to about 10 millimoles per mole of silver, and said thiourea compound is present in an amount of from about 0.001 to about 10 millimoles per mole of silver.

17. A silver halide photographic element adapted to form a high contrast image when developed with an aqueous alkaline developing solution, said element comprising:

(1) surface latent image forming high-chloride silver halide grains in which at least the surface portion thereof is composed of more than 50 mole percent silver chloride, (2) a hydrazine compound that functions as a nucleator, said hydrazine compound having the formula:

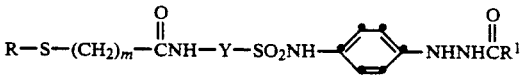

where R is a monovalent group comprised of at least three repeating ethyleneoxy units, m is 1 to 6, Y is a divalent aromatic radical, and $R^1$ is hydrogen or a blocking group.

(3) an amino compound that functions as an incorporated booster, said amino compound having the formula:

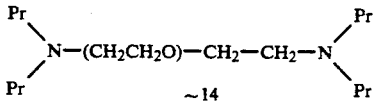

where Pr represents n-propyl;

(4) potassium tetrachloroaurate in an amount sufficient to serve as a chemical sensitizer, and (5) 1-acetyl-2-thiourea in an amount sufficient to serve as a chemical sensitizer.

* * * * *